United States Patent [19]

Aikman

[11] 4,038,994

[45] Aug. 2, 1977

[54] TOBACCO SMOKE FILTER UNIT

[76] Inventor: Leslie N. Aikman, P.O. Box 321, Balboa Island, Calif. 92662

[21] Appl. No.: 693,347

[22] Filed: June 7, 1976

Related U.S. Application Data

[63] Continuation-in-part of Ser. No. 630,092, Nov. 10, 1975, abandoned.

[51] Int. Cl.[2] ..... A24F 13/02

[52] U.S. Cl. ..... 131/187; 131/198 R

[58] Field of Search ..... 131/187, 210, 216, 198

[56] References Cited

U.S. PATENT DOCUMENTS

| | | | |
|---|---|---|---|
| 3,174,487 | 3/1965 | Missler | 131/187 |
| 3,367,343 | 2/1968 | White | 131/187 |
| 3,468,316 | 9/1969 | Baum et al. | 131/187 |
| 3,810,476 | 5/1974 | Thomas | 131/198 R X |
| 3,926,199 | 12/1975 | Thomas | 131/187 |

*Primary Examiner*—Stephen C. Pellegrino
*Attorney, Agent, or Firm*—Grover A. Frater

[57] ABSTRACT

A cigarette holder is disclosed which contains a filtering element in a cavity within the barrel of the holder. The filter element is provided with a flange that extends from the element and divides the cavity into an upstream filtering chamber and a downstream storage and filter chamber. Conformations in the flange permit communication from the upstream to the downstream side of the cavity. Smoke enters the filter cavity through a restricted opening where it is made to pass at high velocity. Thereafter, the smoke is permitted to expand and cool such that the tars and nicotine in the smoke are condensed. The chamber and the filtering element are arranged so that the smoke swirls to impart a kinetic energy to the condensate which results in an inability to follow the conformations past the flange whereby the condensate is made to impinge upon the surfaces of the filter element where it is condensed.

3 Claims, 11 Drawing Figures

TOBACCO SMOKE FILTER UNIT

RELATION TO PRIOR APPLICATION

This application is a continuation-in-part of application for U.S. patent Ser. No. 630,092, filed Nov. 10, 1975 for TOBACCO SMOKE FILTER UNIT, and now abandoned.

BACKGROUND OF THE INVENTION

This invention relates to apparatus for filtering cigarette smoke and it relates in particular to cigarette holders that incorporate a filtering element. While the invention is not limited thereto, it is particularly useful for incorporation in a "smoker's withdrawal kit" of the kind which includes several cigarette holders arranged to admit ambient air to dilute the smoke in different degrees.

One of the more successful methods for enabling smokers to withdraw from the habit of smoking cigarettes involves removing portions of the habit forming nicotine compounds from the smoke. A gradually increasing proportion of those materials is removed and many of the smokers who can make themselves follow such a withdrawal program find that they are able to discontinue smoking. The habit forming materials can be condensed out of the smoke and removed in a filter along with various tarry and liquid materials that can be harmful if inhaled.

It is a feature of that method that the smoker continues to smoke until a time near the end of the process when the proportion of habit forming material is so small that the urge to smoke is slight and quitting is easy. The proportion of nicotine product that is inhaled is reduced by adding ambient air in parallel with the smoke so that the volume of smoke that reaches the smoker's lungs is reduced. While the cigarette is consumed somewhat less rapidly when inhalation suction results in the introduction of ambient air that need not travel through the cigatette, most of the cigarette is consumed between "puffs," and the net effect is that less smoke reaches the user's lungs.

In another method, the proportion of harmful ingredients that reaches the smoker's lungs is reduced, not by introducing fresh ambient air with the smoke, but by increasing the effectiveness of the filtering action. That latter method is costly to accommodate because the filters that are employed near the end of the withdrawal program must be much more effective than the filters that are employed early in the process. As a consequence, different filter designs are required and much more expensive tooling is required. Moreover, effective filters become loaded with solids and semi-solid materials and lose their effectiveness so that they have to be changed frequently. For whatever reason, experience has demonstrated that the filters are not changed with the required frequency to the end that the method is rendered ineffectual. While filters that do not load rapidly can be made, they tend to be expensive, and to occupy an unduly large amount of space.

Some of the more successful smoker's withdrawal apparatus combines the method of admitting ambient air to the smoke stream with the method of increasing the effectiveness of the filtering action. In that combined method it is possible to utilize ambient air in accomplishing the filtering action. Ambient air is cooler than the smoke and it can be used to aid in accomplishing condensation of the solid and semi-solid materials that are customarily called "tars and nicotine."

A number of devices that employ that combined method have been created. The method is conveniently practiced by adding an air inlet opening and a filter to an otherwise conventional cigarette holder. A number of withdrawal kits have been based on that general structural arrangement.

To practice the modified method, it is necessary to have available an apparatus which accomplishes the filtering action and which admits ambient air, and which by alteration of the filtering action or the quantity of air admitted, results in delivery to the smoker of a gas which contains a proportion of tar and nicotine that diminishes with time. That can be accomplished by changing the filter element or by changing the air inlet opening, or both. To change the size of the air inlet opening has been more convenient, and it is the arrangement most often adopted by patentees and producers of smoker's withdrawal apparatus.

Not all who use smoker's withdrawal kits attempt to withdraw entirely from smoking. A large portion of users utilize the withdrawal kit apparatus to limit their intake of tars and nicotine without reduction in their use of cigarettes. The objective of such a user is better served by providing him with an apparatus whose filter element can be cleaned and need not be replaced.

SUMMARY OF THE INVENTION

To provide an apparatus which is useful as a withdrawal kit in that it can be used to reduce tar and nicotine intake with time and which can also be used as a convenient, easily cleaned and effective tar and nicotine filter is one of the objectives of the invention. To create an apparatus which is an effective filter, easily cleaned to maintain its effectiveness, which utilizes ambient air to aid in the filtering action in a way that makes it possible to control the degree of filtering is no easy task. The reason that some cigarette holder and filter constructions prove to be effective and others do not is not at all apparent. It has been discovered that the arrangements of holder and filter that are described herein can be made to remove tars and nicotine from cigarette smoke in any proportion from a very large to a very small proportion by doing no more than altering the size of an inlet opening by which ambient air is admitted to the smoke screen, and to provide that result is one of the objectives of the invention.

Moreover, applicant has discovered a structural arrangement in which that result is provided, notwithstanding that the degree of inhalation suction that the smoker must exert is the same, or at least appears to the smoker to be substantially the same, as is required to smoke a cigarette in the absence of the filter. That is a key element in the success of the invention — whether it be used for complete withdrawal from the habit or to modify the degree of dependence upon nicotine. And in that connection, it is an object of the invention to provide an apparatus that has an appearance, a taste, a feel, and a degree of effectiveness that will encourage its use.

These and other objects and advantages of the invention which will hereinafter appear are realized in part by the provision of a cigarette holder that is formed with a cylindrical cavity in which a generally cylindrical filter element is disposed so that the axis of the filter element is generally coincident with the axis of the cavity. Intermediate its ends, the filter element is provided with an outwardly extending flange that reaches almost, but not quite, to the inner wall that defines the barrel chamber. The periphery of the flange is formed with cutaway portions that form a passageway for smoke from one side of the flange to the other. In the preferred arrangement, smoke and ambient air, in the case where ambient air is admitted to the smoke path, is introduced through a restricted opening at high velocity into the chamber of the barrel on the upstream side of the flange where it is permitted to expand and to move with a great deal of turbulence through a first expansion or filtering chamber. Thereafter, the smoke is drawn through the cut-outs of the flange, past the flange into a second storage chamber prior to being drawn through the mouth piece of the holder to the user. In one preferred form of the invention, the exit opening from that second storage chamber to the mouth piece is partially restricted to the end that the smoke moves in a way that minimizes the deposit of tars and nicotine on the surfaces of the passageway near the outlet bit of the mouth piece.

In one preferred form of the invention, the outwardly extending flange of the filter element is placed near the upstream end of the element and said upstream end is separated from the restricted opening to form a chamber upstream from the element in which flow is made turbulent.

Figure 2:
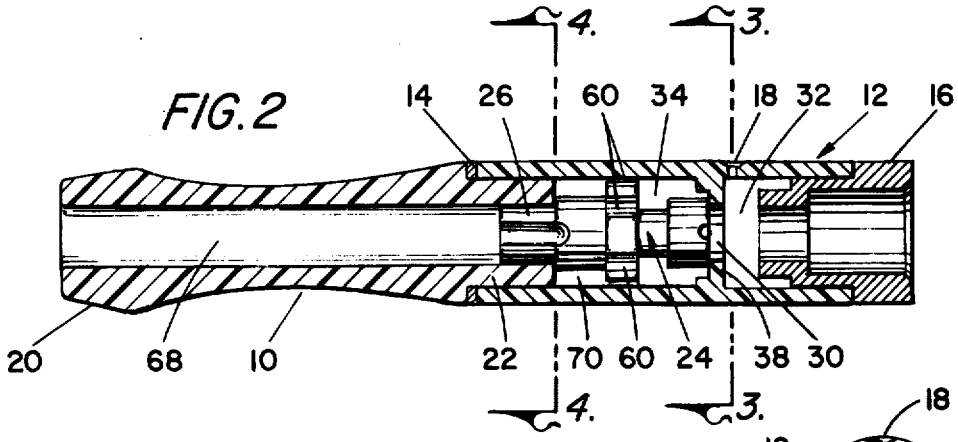
FIG. 2 is a cross-sectional view taken on line 2—2 of FIG. 1.
Figure 6:
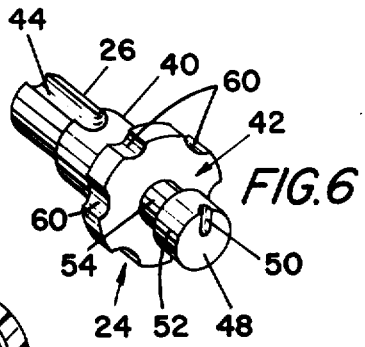
Figure 1:
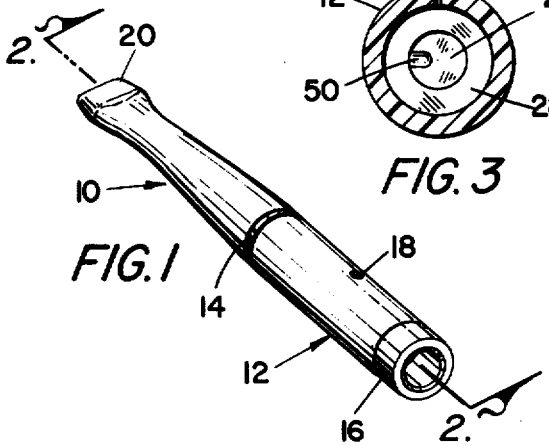
FIG. 1 is an isometric view of a cigarette holder which embodies my invention.
Figure 3:
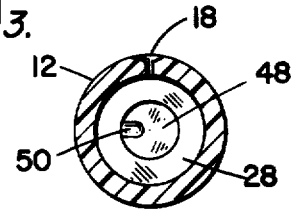
Figure 4:
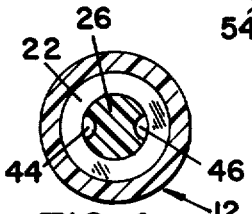
Figure 8:
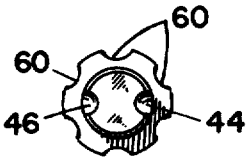
Figure 7:
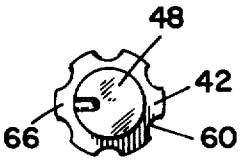
Figure 5:
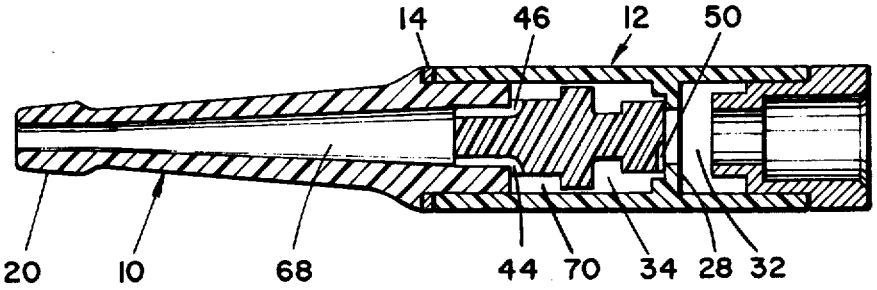
Figure 9:
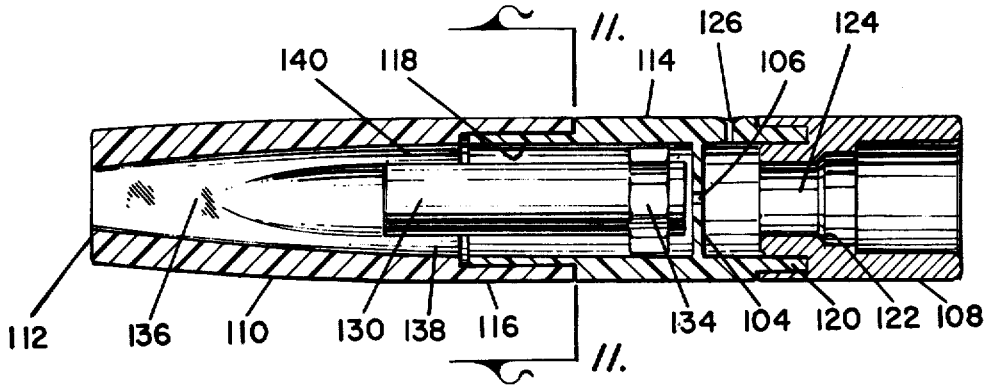
Figure 10:
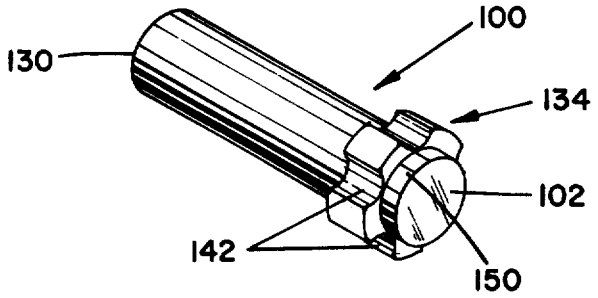

FIGS. 3, 4, and 5 are cross-sectional views taken on lines 3—3, 4—4, and 5—5, respectively, of FIG. 2;

FIG. 6 is an isometric view of the filter element employed in the holder;

FIGS. 7 and 8 are views of the upstream end and downstream end, respectively, of the filter element;

FIG. 9 is a cross-sectional view of a modified form of the holder of FIG. 1, taken on the horizontal mid-plane of the holder;

FIG. 10 is an isometric view of the filter employed in the unit of FIG. 9; and

Figure 11:
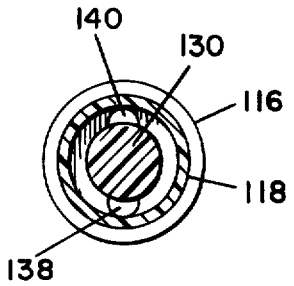

FIG. 11 is a cross-sectional view taken on line 11—11 of FIG. 9.

DESCRIPTION OF THE PREFERRED EMBODIMENT

It is preferred that the invention be incorporated in a structure which looks like a conventional cigarette holder except that the barrel portion of the structure may be slightly longer than it is in a conventional holder that includes no filtering element. Such a structure is shown in FIG. 1 where it includes a mouth piece 10 which extends rearwardly from a barrel 12. The two are separated by a trim piece 14 in the form of an annular plastic ring. In this embodiment, a metal coupler 16 is inserted in the forward end of the barrel 12. It has a stepped internal diameter to accommodate cigarettes of regular and reduced diameters. The barrel is formed with an air inlet opening 18 by which ambient air may enter into the interior of the barrel.

That air inlet opening 18 is visible in the longitudinal cross-section depicted in FIG. 2 and in the transverse cross-section of FIG. 3. The opening itself is quite small and it is counter-sunk at the exterior surface of the barrel 12 so that the user can identify it. A "Smoker's withdrawal kit" may include a single stem and several barrels. One barrel, the one that is first used in the withdrawal process, may have no air inlet opening. The openings differ in size and it is intended that the user who is attempting to withdraw from the cigarette habit begin with the barrel having the smallest inlet opening which is replaced after a period of time with the barrel having the next larger opening, and so on.

The trim ring or annulus 14 and the cigarette coupler 16 are circular in cross-section and they are both symmetrical about their central axis. Except for the air inlet opening 18, the barrel 12 is uniform about its central axis.

The forward end of the mouth piece 10 is circular in cross-section and is symmetrical about its center line as best shown in FIG. 2, and the transverse cross-section of FIG. 4. That symmetry becomes less in the direction of the bit 20 at the output end of the mouth piece 10. The shape is the conventional shape employed in cigarette and cigar holders and smokers' pipes. FIG. 1 and the cross-sectional views of FIGS. 2 and 5 show that shape.

The mouth piece 10 terminates at its upstream end in a coupler 22 which has the form of a forwardly projecting sleeve whose outside diameter is such as to slide into and accommodate the rearward or downstream end of the barrel with a sliding fit. The central opening of the coupler 22 has diameter to receive the end of a filter element 24 which is housed within the barrel and is held in place by having its downstream stem 26 inserted into said central opening of coupler 22.

As best shown in FIG. 2, the interior of the barrel 12 is divided into an upstream and a downstream portion by a barrier wall 28 which extends transversely across the interior of the barrel in the mid-region of its length. It is formed with an axial opening 30. When the front opening of the holder is closed by the insertion of a cigarette into the coupler 16 and the rear of the barrel is closed by assembly onto the coupler 22 of the mouth piece, the barrier wall 28 divides the interior of the barrel into two cavities, the upstream one of which is designated 32 and serves as a storage chamber for smoke and as a mixing chamber for smoke and air in the case of those barrels that have an inlet opening corresponding to opening 18. Opening 30 affords communication past the barrier from the storage and mixing chamber 32 to a cylindrical chamber 34 in which the filter element is housed. In the preferred form of the invention, a means is provided by which smoke, or the mixture of smoke and air, is greatly accelerated as it moves from chamber 32 to chamber 34. There are a variety of structural arrangements by which that can be accomplished. In the preferred arrangement, the flow is made highly turbulent in the filtering chamber 34. That can be in this embodiment by arranging the entry path so that flow is transversed to the axis through the holder such that it impinges upon the side wall of the chamber and is made to change the flow direction immediately.

The tars and nicotine are removed from the smoke by a condensation process followed by a deposition of the condensate on the surface of the filter element by imparting to them a kinetic energy that precludes their negotiating the flow path through the labyrinth. The objective is to have the tars and nicotine deposited on the filter element rather than on the interior of the barrel. Cooling of the smoke is accomplished by compressing it and then permitting it to expand and cool in the filtering chamber. Removal of a large percentage of the tars and nicotine content of the smoke is accomplished with relative ease. That can be done by providing a restricted passageway for smoke flow so that the smoker must apply a heavy inhalation suction. The compressed smoke is then greatly expanded so that its temperature is reduced enough to condense out most of the tars and nicotine. Thereafter, it is necessary only to move the tar and nicotine particles rapidly so that they acquire sufficient kinetic energy to prevent their turning a corner in the flow path for smoke whereby they will impinge upon and be deposited upon a filter surface. However, the objective is not simply to conduct that process as efficiently as possible. In a typical withdrawal kit in which withdrawal is to be accomplished in four or five steps using four or five different holder barrels and a single filter element, it is desirable that the filter element be effective to remove from 25 to 30 percent of the tars and nicotine content of the smoke when using the apparatus that is designed for use in the first step of the process. An attempt is made to remove an additional 15 or 20 percent of the tars and nicotine at each new step in the withdrawal process until about 90 percent of the tars and nicotine are removed in the final step.

That kind of step-by-step reduction of bad components in the smoke is possible in the invention using a single filter element by changing holder barrels so that different amounts of ambient air are drawn into the smoke path. The first used barrel has no ambient air inlet opening. The filtering element and the smoke flow path can be arranged so that 25 to 50 percent of the tars and nicotine, as a consequence of the configuration of the filter element and the cross-sectional area of the flow path as it approaches, passes, and leaves the filtering chamber. The task is not only to remove that amount of tar and nicotine but to do it in a way that results in the deposition of the filter element rather than upon the interior wall of the holder barrel. The barrel is easily removed from the mouth piece. Although the filtering element is arranged so that it can be removed, it is not removed when the barrel is removed but remains attached to the holder so that it can be cleaned by washing or simply by being wiped with a paper napkin. It is also desirable that all of the tar and nicotine that is to be removed is removed before the smoke enters into the mouth piece where it is difficult to clean away.

Those objectives are realized by providing a filter construction and flow path arrangement in which the filtering action is made more effective by utilizing ambient air to accomplish a greater degree of cooling within the filtering chamber without changing the pattern of flow through the chamber or the velocity of flow. One of the difficulties in the filtering action is that flow velocity and pressure change is dependent upon inhalation suction pressure which varies greatly during the period of a "puff," and "puff to puff." The change in inhalation suction pressure is normalized in part by incorporating smoke storage chambers at strategic points along the flow path.

While a number of prior cigarette holder and filter structures have utilized these principles with varying degree of success, it is not possible to extrapolate with any reasonable degree of success what structural arrangement can provide the desired results. The discovery that is the subject of this application has several structural features not found in earlier designs, but it has proven to be very effective in accomplishing the desired result. A preferred form of filter element is shown in FIGS. 6, 7, and 8. It is a generally cylindrical structure having a flange extending outwardly from its mid-region. The flange lies perpendicular to the axis of the unit and it extends for a length, in the direction of the axis, which is only a small fraction of the length of the element. As previously described, the filter element is assembled with the mouth piece by inserting its downstream stem 26 into the central opening of the coupler 22 of the mouth piece. That stem has slightly smaller diameter than the section of its length 40 which extends from the stem to the downstream face of the flange 42. The shoulder at the junction of stem 26 and section 40 abuts the forward face of the coupler 22. A pair of grooves are formed in the stem to provide a pathway for smoke past the coupler. Those grooves extend longitudially of the filter element over the entire length of the stem 26 and they continue in the rearward, or downstream, portion of the element suction 40. There are two of those grooves. One of them is identified by the reference numeral 44 and the other by the reference numeral 46. Both grooves are visible in FIGS. 4, 5, and 8.

The filter element 24 is sufficiently long from the shoulder between sections 26 and 40 and its forward, upstream face 48 so that the face engages the barrier 28 of the barrel when the barrel is fully assembled on the coupler 22 of the mouth piece. The diameter of the filter element is greater than the diameter of the passageway 30 through the barrier 28 whereby that the surface of the barrier at the margin of opening 30 bears against the outer margins of the forward face 48 of the filter element. By that arrangement, flow through the opening 30 is substantially precluded except through a restricted opening which is formed as a recess or cut-out in front face 48. That recess is identified by the reference numeral 50 and it extends from the mid-region of the face to the edge of the face where it opens at the side of the forward section 52 of the filter element. While not essential to successful practice of the invention, the preferred embodiment has reduced diameter in a section 54 between the forward section 52 and the flange 42. The reduction in diameter increases the volumetric capacity of the filter chamber 34.

The cut-out 50 serves as a restricted passage as best shown in FIG. 5 by which flow proceeds from the mixing chamber 32 to the filtering chamber 34. In the preferred embodiment of the invention, the inner wall of the barrel 12 has reduced diameter at a point immediately downstream of the barrier 28. The result of that is to form a shoulder at a point closely adjacent to the exit opening of the restricted passage 50. Inclusion of that shoulder helps to prevent the deposition of tars and nicotine on the inner surface of the barrel because it prevents a rapid reduction of velocity of the smoke at the point of emergence from the restricted passageway. The result is a slightly more gradual expansion of the gasses and a postponement of the cooling until the smoke is moved somewhat beyond the point of emergence from the outlet opening 50. That structure comprises a means for preventing or reducing condensation until after the smoke and its bad components have been burned away from the inner surface of the barrel, and for causing the smoke to swirl and to be very turbulent.

The diameter of the flange 42 may be such as to make a tight fit with the inner surface of the barrel 12. However, if the outside diameter of the flange 42 is made almost equal to the inner diameter of the barrel, but somewhat less, so that there is a space between them through which smoke can flow, the result is substantially less deposition of tar and nicotine on the inner surface of the barrel.

A relatively large area flowpath is provided past the flange 42 by cutting away portions of the outer periphery of the flange. The shape shown in the drawings works well and is considered to be a preferred form. Six scallop shaped cut-outs are spaced equally around the periphery. They extend from the forward to the rearward face of the flange and are relatively shallow. The drawing is proportioned to show approximately what appears to be the best relative size for those openings. Each cut-out has approximately twice the cross-sectional area of the restricted passage 50 and approximately half of the cross-sectional area of the cut-outs 44 and 46. The result is that the greatest restriction to flow occurs at the restricted inlet opening 50. Restriction is substantially less at the cut-outs 44 and 46 and it is much less past the flange through its cut-outs 60.

Whatever the reason, when the apparatus is used, not much tar and nicotine is deposited upon the interior surface of the barrel. What little is deposited there is deposited primarily on the inner surface overlying sections 52 and 54 of the filter element. A much larger proportion of the tar and nicotine is deposited on the surfaces 52 and 54. Most of the tar and nicotine is deposited upon the upstream 66 of the flange 42. A lesser quantity of tar is deposited upon the surface of the flange in the scallop shaped cut-outs 60. If the holder is used in the smoking of a substantial number of cigarettes without being cleaned, the scallops 60 become loaded with tars and nicotine and the flowpath area is reduced. However, there is little deposition of tars in the cut-outs 44 and 45 and in the passageway 68 through the mouth piece. That passageway has a large cross-sectional area. Smoke flow is introduced into passageway 68 through the cut-outs 44 and 46 in a way that appears to produce substantially laminer flow. There is almost no deposition of tars in the mixing chamber ahead of the barrier 28 so it is theorized that there is no condensation of tar and nicotine until the smoke reaches the filtering chamber 34. There it expands and is cooled. Small particles of solid and semi-solid and liquid tar and nicotine, having small mass, are made to swirl around with the smoke, although at reduced velocity. Particles of condensate impinging upon one another are joined to form larger and heavier particles. The fact that those solid and liquid particles are deposited on the surfaces at the rear or downstream end of that chamber suggests that the shape of the filter element and the fact that the smoke enters the chamber at one point, or two, if the cut-out 50 is made to extend entirely across the front face of the element, results in a swirling action in which much kinetic energy is imparted to the condensate to the end that the condensate cannot "turn the corner" as the smoke changes direction to move through the cut-outs 60. Instead, the condensate impinges upon the surfaces of the filter element where it adheres. The area of the flow path from that point to the bit 20 is such that smoke having passed through cut-out 60 is not expended sufficiently to permit further condensation. Cut-outs 44 and 46 are arranged so that the gas may proceed through the exit chamber 70 at the downstream side of the flange 42 with sufficient ease so that there is not much cooling as the smoke passes into that chamber.

The restricted opening 50 offers a significant amount of impedence to the flow of smoke. However, a substantial amount of smoke is stored in the passageway 68, in the outlet chamber 70 and in the filtering chamber 34. Smoke is drawn from those storage areas at the initiation of an inhalation suction so the requirement for high flow through the passageway 50 does not occur as a step function, but is delayed slightly. There is an additional delay in the application of suction pressure because of the storage capacity of the user's mouth and lungs. As a consequence, the muscular action that takes place within the user at the beginning of an inhalation suction has proceeded to the point where there is a momentum in that movement that makes resistance to flow in the passageway 50. Accordingly, users feel that the holder "draws easily," notwithstanding that a substantial resistance to flow is offered.

One of the major advantages of the invention from a production and user standpoint is that no particular relative orientation is required between the position of inlet 18, the direction of restricted passage 50, the radial position of cut-outs 60, or the outlet passages 44 and 46. The filter element may be made removeable, a feature which greatly simplifies tooling and molding costs, because no orientation need be observed in assembling the filter element on the mouth piece. The user need not orient the barrel relative to the mouth piece to get the inlet opening in any "right place" and so no assembly instruction is required.

The purchaser is provided with a device which can help him withdraw from smoking with the exercise of less will power or which can be used as a filtering unit to remove half or more of the condensable constituents of tobacco smoke. The taste will change, but the change is made gradual and accommodation to that change is made easier because the apparatus does not change the way that it "feels" to smoke.

That the invention can be practiced with some change in structural form is illustrated in FIGS. 9, 10, and 11. The embodiment shown in those figures differs primarily in the way that smoke is accelerated as it flows into the filtering chamber. The method employed is the same in that smoke is stored, accelerated, slowed and made turbulent in the same sequence as in the embodiment of FIGS. 1 through 8. However, this embodiment has three advantages. Less suction pressure is required in its use, the filter element is formed with a more simple surface configuration which makes it easier to clean, and the action is such that almost no tar and nicotine are deposited on the interior surface of the barrel. Structures like the shoulder just downstream from barrier 28 in the first described embodiment are not needed to keep the barrel clean.

The filter element 100 in FIGS. 9 and 10 has its upstream face 102 spaced from the barrier wall 104. The opening 106 in the barrier is made very small so that it serves as the means for accelerating smoke as it flows into the filtering chamber. Unlike the first described embodiment in which the smoke was accelerated laterally into the filtering chamber, the accelerating opening in this embodiment is arranged so that the smoke is accelerated axially into that chamber so that it impinges approximately at the center region of the forward face 102 of the filter element 100. Having in mind that the inner diameter of the coupler is approximately the same as that of a regular sized cigarette, the forward face of the filter element may be removed by as much as an eighth of an inch, or even more, from the barrier 104 without loss of effectiveness. A lesser separation is preferred, and has been selected for illustration in the drawing. The separation shown in FIG. 9 represents approximately the minimum separation between the rear face of the barrier and the forward face of the filter element.

That discussion assumes, and it is true, that the structure of the holder of FIG. 9 is substantially the same as in the structure of the first described embodiment. In FIG. 9, the holder has a cigarette coupler 108 at its upstream end. It has a bit member 110 at its downstream end. At its outlet end 112, the bit is more wide than it is high. When held between the user's teeth, the holder is oriented so that the wide portion extends horizontally. Thus, what is shown in FIG. 9 is a sectional view taken through what is ordinarily the horizontal plane.

The coupler 108 and the bit, or shank, 110 are interconnected by the barrel 114. The bit shank 110 and the barrel 114 telescope together. The downstream end of the coupler has reduced diameter and fits within the upstream end of the bit shank whose inner diameter at that end 116 is increased to receive the downstream end 118 of the coupler.

In this embodiment, the upstream end 120 of the coupler has reduced diameter and it fits into an annular recess formed in the rear face of the coupler 108. The interior of the coupler 108 has different diameters over its length to accommodate cigarettes of different diameter. The last step in diameter is made to provide a shoulder 122 which serves as a stop against further insertion of cigarettes whereby the cigarette end is spaced from the barrier 104 to provide an upstream storage chamber 124. Ambient air is drawn into that chamber through an air inlet opening 126 formed through the wall of the barrel portion of the holder. That inlet opening 126 introduces ambient air at a point just upstream from the barrier 104.

Except for the barrier 104 which divides the barrel into an upstream and a downstream chamber, the barrel is essentially a cylindrical sleeve so that the chamber downstream from the barrier wall 104 is a cylindrical recess. The forward part of the filter element 100 is disposed in that recess with its axis substantially coincident with the axis of the barrel and of the holder. The downstream end 130 of the filter element is inserted into a receiving opening formed at the interior of the bit shank just downstream from the forward coupler sleeve 116. In this embodiment, the portion of the filter element downstream from the flange 134 has uniform diameter. The smoke passages from the filter chamber to the passage 136 in in the bit shank are formed at the inner surface of the bit shank as best shown in FIG. 11. There are two passageways identified by the reference numerals 138 and 104, respectively.

The flange portion 134 of the filter element has the same shape in this embodiment as it does in the embodiment illustrated in FIGS. 6, 7, and 8. While the cut-outs 142 can have other shape, the scalloped configuration shown in the drawings has proven to be the most effective. While the reason for that is not known, the fact that it is most effective is especially fortuitous because a filter element of that shape is relatively easy to keep clean. The element 100 can be thought or as being similar to element 24 and differing only in that its upstream end has been cut off. The element 100 can also be described as being generally cylindrical and of uniform diameter except for having an outwardly extending, scalloped flange at a point intermediate its ends and particularly closely adjacent to its upstream end. It is preferred that the flange be removed somewhat from the upstream end or face 102. The absence of any extension beyond the flange reduces effectiveness. However, the length of the portion 150 lying forward of the flange may be proportionally substantially less than what is shown in the figures without any substantially adverse affect on performance. Moreover, the scalloped flange 134 can be further removed from the front face 102 than what is shown in the drawing without any serious diminuition of the filtering action. The arrangement shown in the drawings depicts an acceptable combination of flange position, relative size of the filter element parts, and the interior dimensions of the barrel, and of spacing between the filter element and the barrier.

When the holder shown in FIG. 9 is used to filter smoke from a cigarette inserted into the coupler 108 the application of inhalation suction at the outlet end 112 results in smoke being drawn into the storage chamber 124 together with ambient air which is drawn through opening 126. Smoke and ambient air are mixed in that chamber and they are withdrawn from the chamber 124 through the accelerating opening 106 in the mid-region of the barrier 104. That smoke is accelerated rapidly as it moves through the opening 106, and the smoke with its intrained liquid and solid tar and nicotine materials impinges upon the forward face 102 of the filter element. The accelerating opening 106 is relatively small. It may be less than 1/32nd of an inch in diameter in a typical case. The acceleration through that opening is great and the intrained liquids and solids reach a velocity substantially equal to that of the smoke. Because of their greater weight, the liquid and solid components of the smoke have a higher kinetic energy than does the gaseous portion of the smoke. While the gas can change direction and flow outwardly with ease, some of the intrained solid and liquid materials will be unable to turn and will impinge upon and adhere to the forward face 102 of the filter element. Although it appears to be small in the drawings, the volume in the filter chamber upstream from the flange 134 is very much greater than the volume occupied by the smoke as it passes through the accelerating opening 106. The result is a great deal of expansion and cooling of the smoke. Cooling is sufficient so that a substantial amount of tar and nicotine is rapidly deposited upon the face 102. As material is deposited on that face, separation between the effective face of the filter element and the barrier wall 104 is decreased. How rapidly it occurs depends upon the amount of initial separation between face 102 and the downstream surface of the barrier wall. But eventually that space will be reduced and the amount of expansion of gas immediately after passing through the opening 106 will be limited as the deposit of tar and nicotine on the forward face of the filter element approaches opening 106.

In increasing degree, as more smoke is drawn through the holder, tar and nicotine products tend to be deposited on the surface of the section 150 of the filter upstream from the flange 134. As that section becomes covered with tar and nicotine, the deposition of materials on the surface of the filter element begins to occur primarily in the scallops 142 of the flange 134. As additional cigarettes are smoked without cleaning of the filter element, the deposit of tar and nicotine materials occurs on the surface of the filter element downstream from the flange 134. Again, this form of the invention is particularly useful because throughout the period from cleaning of the filter element until its surface is largely covered with tar and nicotine products, virtually no material is deposited on the interior surface of the barrel 114. That means that the unit can be almost completely cleaned by cleaning its filter element 100. That element can be cleaned either by wiping the deposits from it or it can be cleaned in water.

The dimensions of the several parts of the holder and of its several cavities can be described approximately in terms of the diameter of cigarettes. Diameters are no longer standard in the form that existed before. But the standard is in the neighborhood of 35/100ths of an inch. In preferred form, the filter cavity in the barrel has an inside diameter approximately like that of the outside diameter of a cigarette. The filter element has an outside diameter approximately one-half to two-thirds of the inner diameter of the cavity. The cavity length is approximately twice its diameter. Its volume is nearly the same as the volume of the storage space ahead of the barrier, although the volume of that space is variable depending upon the diameter of the cigarette with which the holder is used. As indicated above, the outer diameter of the flange is just less than the inner diameter of the cavity in which it is housed. The width of that flange is not particularly critical except that it must be sufficiently long so that flow is directed through it in paths that are generally parallel to the axis of the unit.

On the other hand, if it is too long, the flow emanating from the cut-outs in that flange will not be sufficiently turbulent downstream from the flange. A good compromise appears to make the flange approximately half as wide as the diameter of the body of the filter element. In the embodiment shown in FIG. 9, it is preferred that the portion of the body that extend forwardly of the flange, portion 150 in FIG. 10, be less than half of the diameter of the body. Thus arranged, the flange is positioned at a distance from the forward face of the body less than its own width. The opening 106 should be no greater than 1/16th of an inch, and, in the case in which the upstream face of the filter element is positioned more rearwardly than shown in the drawings, the size of opening 106 should be decreased. The air inlet opening 126 has a size that is selected on the basis of the amount of air that is to be drawn into the holder in parallel with smoke from the cigarette. Its diameter may vary between 1/64th and 1/32nd of an inch in an average set of holders in a withdrawal kit.

Although I have shown and described certain specific embodiments of my invention, I am fully aware that many modifications thereof are possible. My invention, therefore, is not to be restricted except insofar as is necessitated by the prior art.

I claim:

1. In a smoker's withdrawal kit of the kind in which a cigarette holder comprising a mouth piece attached to one end of a barrel is formed with a barrier wall which extends across the interior of the barrel at a point spaced from the mouth piece such that a cylindrical cavity is formed within the barrel between the barrier wall and mount piece into which smoke may flow through a central opening in the barrier and from which it flows through an opening in the mouth piece, the improvement which includes:

a filter element disposed in said cylindrical cavity;

said element comprising a cylindrical body disposed with its axis substantially coincident with the axis of said cavity and having a diameter greater than said central opening in said barrier and less than the outside diameter of said cavity;

said element being formed with an outwardly extending flange intermediate its ends, the flange extending in a plane perpendicular to the axis of the element and having a diameter nearly equal to but less than the inner diameter of said cavity in the region of said flange, the outer periphery of said flange being formed with at least one cut-out to form a passageway through said cavity via said cut-out;

said flange being formed with a plurality of cut-outs spaced around its outer periphery to form parallel paths for smoke past said flange;

said cut-outs being formed as scallops and being spaced around the periphery of said flange; and the forward face of said filter element being spaced downstream from said barrier and means comprising the central opening in said barrier for accelerating the passage of smoke through the barrier and directing its flow toward said forward face of the filter element.

2. The invention defined in claim 1 in which said flange has a width between one-fifth and one-third of its diameter.

3. The invention defined in claim 2 in which the flange is positioned on said filter element at a distance less than its width from the forward face of said filter element.

* * * * *